United States Patent [19]

Hedgewick

[11] 4,090,629

[45] May 23, 1978

[54] SPIRAL LOCK SAFETY CLOSURE

[75] Inventor: Peter Hedgewick, Windsor, Canada

[73] Assignee: International Tools (1973) Limited, Windsor, Canada

[21] Appl. No.: 826,493

[22] Filed: Aug. 22, 1977

[51] Int. Cl.[2] ..... B65D 53/00; B65D 55/02

[52] U.S. Cl. ..... 215/214; 215/222

[58] Field of Search ..... 215/213, 211, 214, 212, 215/222, 354, 342, 350, 351

[56] References Cited

U.S. PATENT DOCUMENTS

| | | | |
|---|---|---|---|
| 3,623,623 | 11/1971 | Baver | 215/213 |
| 4,049,148 | 9/1977 | Suhr et al. | 215/214 |

*Primary Examiner*—George T. Hall

*Attorney, Agent, or Firm*—Reising, Ethington, Barnard, Perry & Brooks

[57] ABSTRACT

A safety closure and container assembly including a container, cap and combined spring and sealing member. A retention rib is formed on the inner surface of the skirt of the cap, and a spring and sealing member has a radially projecting flange that engages the retention rib to prevent separation of the spring and sealing member from the cap. Cap and container locking elements are formed respectively on the inner surface of the skirt of the cap and the outer surface of the mouth of the container. The cap and container locking elements are engageable with and disengageable from each other by combined axial and rotary motion of the cap relative to the container. The spring and sealing member biases the cap and container locking elements toward locked engagement with each other when the cap is applied to the container. The cap and container locking elements are formed such that the sealing portion of the spring and sealing member is forced into the mouth of the container into sealing engagement therewith as the cap is rotated relative to the container so that the operator does not have to apply direct axial force to the cap in order to seal the container.

3 Claims, 7 Drawing Figures

SPIRAL LOCK SAFETY CLOSURE

BACKGROUND OF THE INVENTION

1. Field of the Invention

This invention relates generally to safety closure and container assemblies, and is particularly concerned with an improvement in safety closure and container assemblies wherein it is necessary to provide a liquid or moisture proof seal for the contents of the container.

2. Description of the Prior Art

In order to reduce the number of accidental poisonings resulting from young children having access to unsafe medicines, drugs, household chemicals and other products, there has been considerable activity in recent years toward the development of closures and containers in which a type of manipulation between the cap and container is required in order to gain access to the contents of the container that a young child is incapable of performing. For example, it has been found that young children are generally incapable of manipulating a cap mounted on a container with bayonet-type locking means—a type of locking means that requires that the cap be pushed relative to the container and then rotated relative to the container in order to separate the cap from the container. The cap must be pushed axially toward the container against the biasing force of a spring in order to disengage the bayonet locking means. See, for example, Hedgewick U.S. Pat. No. Re. 27,156. Other examples of safety closure and container assemblies having various locking and sealing arrangements are disclosed in U.S. Pat. Nos. 2,776,066; 3,445,022; 3,608,763; 3,675,804; 3,739,933; 3,741,421; 3,888,376; 3,794,200; 3,952,899; 3,963,139; 3,979,001 and 4,032,028.

When the contents of the container is liquid, or is some substance that deteriorates in an atmosphere of high humidity, the closure must be capable of maintaining an adequate seal under a variety of conditions. The contents of the container, if liquid, may require vigorous shaking before being used, or the contents may be of the type that causes a pressure buildup within the container over a period of time. A tight seal is also necessary in order to prevent the undesired escape of the contents from the container, and because the entrance of moisture and other contaminents into the container may cause deterioration of the contents.

In order to maintain a good seal against the entrance or escape of moisture, it is desirable to be able to provide a seal that projects into the mouth of the container and engages the inner surface of the container mouth with a tight fit. While the spring force on the cap should be sufficient to prevent children from gaining access to the contents, it should not be so great as to make it unduly difficult for adults to manipulate the cap. Accordingly, a tight seal must be maintained by the closure without at the same time making it too difficult for adults to manipulate the closure.

In order to provide a tight, moisture proof seal, it is generaly necessary for the cap to carry a sealing member with a flange that projects into the mouth of the container into tight, sealing engagement with the inner surface thereof. U.S. Pat. Nos. 3,432,065; 3,753,510 and 3,974,928 each disclose safety closure and container assemblies having sealing members that are pushed into the mouth of the container by dome-shaped spring portions on the sealing members. See also U.S. application Ser. No. 739,172 of Suhr and Hedgewick, filed Nov. 5, 1976, now U.S. Pat. No. 4,049,148. Considerable force is required in order to insert and remove such sealing members from the mouth of the container. With conventional bayonet locking elements on the cap and container of the type shown in the patents referred to in the preceding paragraph, the seal is inserted into and removed from the container primarily by the application of direct axial force between the cap and container. The operator, in applying the cap to the container, must first exert considerable axial pressure between the cap and container in order to force the seal into the mouth of the container before the cap is rotated into locked engagement with the container. Conversely, in order to remove the cap from the container, after the cap has been unlocked from the container, the operator must pull the cap and seal axially from the container with a force sufficient to overcome the resistance of the seal to disengagement from the container. For the aged, arthritic or otherwise infirm user, the force required can cause considerable inconvenience.

SUMMARY OF THE INVENTION

An object of this invention is to provide a safety closure and container assembly wherein a moisture proof seal is provided by a sealing member that projects into the container mouth with cap and container locking means provided which will permit the cap to be applied to the container with a smooth, rotatable motion relative to the container to force the sealing member into tight engagement with the mouth of the container and wherein the locking means engage after the sealing member is pushed into the container such that the cap can be disengaged from the container only by first pushing the cap axially against a spring force on the sealing member and then rotating the cap relative to the container.

A further object is to provide a tight, moisture proof safety closure and container assembly having improved locking means that will permit the cap to be applied to the container with a smooth, rotatable motion requiring little strength on the part of the user.

In carrying out the foregoing, and other objects, a child resistant closure assembly according to the present invention includes a cap having an end wall with a skirt projecting therefrom with locking means formed on and projecting from the inner wall of the skirt for selective engagement with and disengagement from complementary locking means formed on the container. The cap locking means includes at least two sets of cap locking elements, each set being disposed in a helical path on the inner surface of the skirt. Each of the cap locking elements includes an elongated thread-like rib having a trailing end located at the trailing end of the helical path and a leading end located near the free end of the skirt. The cap locking elements further includes a pair of spaced locking lugs, the first one of which is located at the leading end of the helical path and the second one of which is located between and spaced from the first lug. The container locking means includes at least two sets of container locking elements. Each set of container locking elements includes an elongated guide rib located along a first container helical path on the outer surface of the mouth portion of the container. Each set of container locking elements further includes a pair of spaced stop members located in a second container helical path offset from the first helical path. When the cap is applied to the container, the cap locking elements are cammed downwardly by the elongated guide rib until the leading locking lug engages a locking ramp to cam the locking lugs into locked engagement with the stop members. The elongated thread-like member of the cap locking elements engages the underside of the guide rib on the container to prevent axial separation of the cap and container, the engagement of the locking lugs and stop members preventing rotary motion of the cap relative to the container. To remove the cap, the cap is pushed axially toward the container to disengage the locking lugs from the stop members to permit reverse rotation of the cap relative to the container.

Other objects, advantages and features of the invention will become apparent from the following description taken in connection with the accompanying drawings.

DESCRIPTION OF THE PREFERRED EMBODIMENTS

Figure 1:
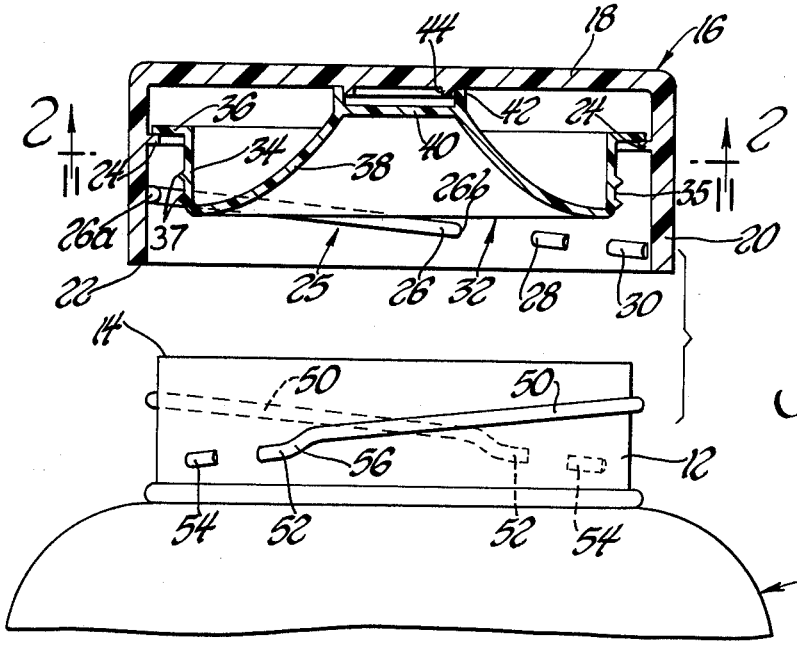
FIG. 1 is a sectional view of one form of safety closure assembly embodying the invention, the closure assembly being removed from the container.
Figure 2:
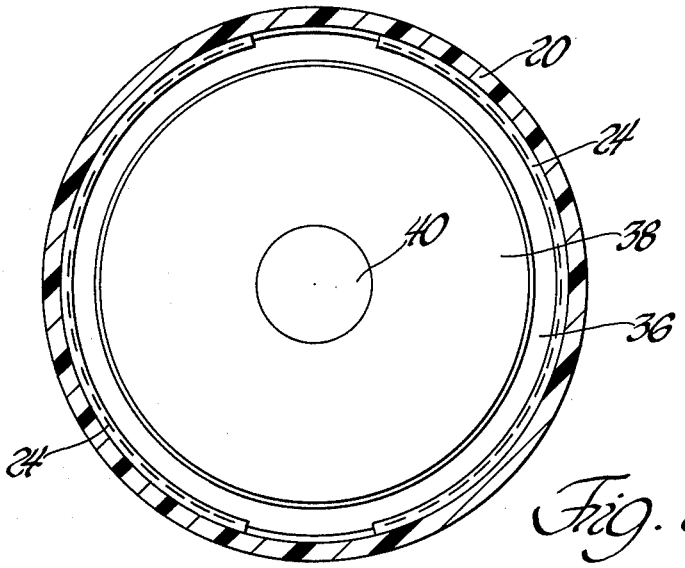
FIG. 2 is a sectional view taken on lines 2—2 of FIG. 1.

With reference to the drawings, a safety closure and container assembly according to the embodiment of FIGS. 1–6 includes a container designated generally by reference numeral 10 and having a neck or mouth portion 12 with an annular rim 14.

The safety closure assembly of FIGS. 1–6 includes a cap 16 having an end wall 18 with a peripheral skirt 20 projecting axially therefrom for receiving the mouth portion 12 of the container 10. The skirt 20 has a free end 22 opposite the end wall 18 of the cap 16.

Figure 3:
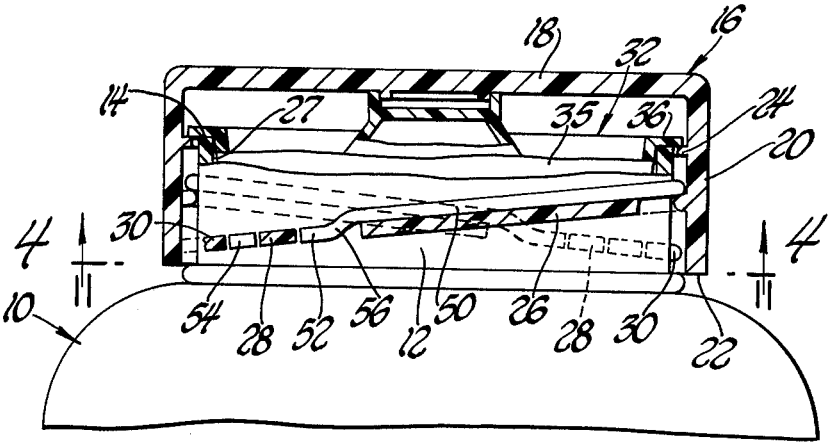
FIG. 3 is a view similar to FIG. 1 with the closure assembly of FIG. 1 applied to the container.
Figure 4:
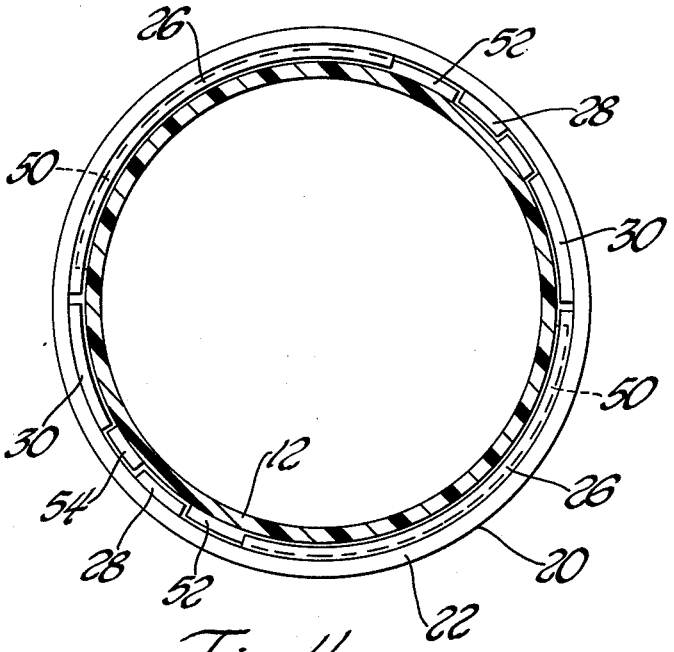
FIG. 4 is a sectional view taken on lines 4—4 of FIG. 3.
Figure 5:
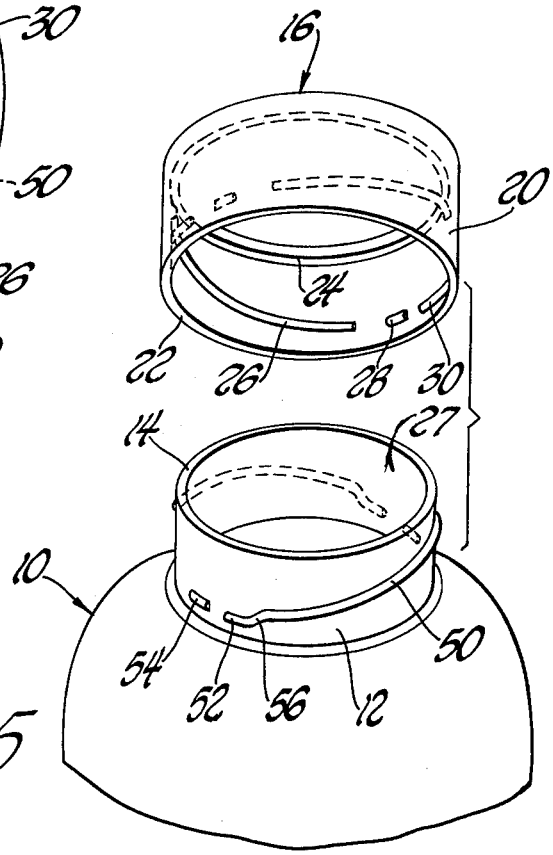
FIG. 5 is an exploded perspective view of the cap and container with the spring and sealing member omitted.

When the cap 16 is mounted on the container in the closed and locked position shown in FIG. 3, it is biased against movement from locked engagement with the container by a one piece plastic spring and sealing member designated collectively by reference numeral 25.

The inner surface of the skirt 20 of the cap is formed with retention means for the sealing member 25, as well as cap locking means. The retention means is in the form of a pair of semicircular ribs 24 projecting inwardly from the skirt 20. The sealing member 25 engages the retention ribs 24 to prevent axial separation of the spring and sealing member 25 from the cap 16.

The cap locking means includes at least two sets of cap locking elements. Each set of cap locking elements is disposed in a helical path on the inner surface of the skirt 20. Each set of cap locking elements includes an elongated rib 26 having a trailing end **26*a* and a leading end 26*b* (FIG. 1). The trailing end 26*a* is located axially between the retention ribs 24 and the leading end 26*b*. The trailing end 26*a* of each rib 26 defines the trailing end of the helical path of each set of locking elements on the cap. The cap locking elements also include a pair of spaced locking lugs 28 and 30, the locking lug 30 being located at the leading end of the helical path. The locking lug 28 is located between locking lug 30 and the leading end 26*b* of the rib 26**.

The spring and sealing member 25 comprises a one piece molded plastic body having an annular sealing portion which, when the closure assembly is applied to the container as illustrated in FIG. 3, engages the rim 14 and the inner surface 27 of the mouth portion of the container.

The sealing portion of the member 25 includes a cylindrical sealing wall 34 having an outer surface 35 for engaging the inner surface of the mouth of the container, and a flange 36 projecting radially outwardly from the upper or outer end of the sealing wall 34 for overlying the container rim 14. In the illustrated embodiment, a pair of axially spaced ribs 37 are formed on the surface 35 of the sealing wall 34.

The spring and sealing member 25 includes a dome-shaped plunger portion having a cylindrical base portion 42 which is concentric with the sealing wall 35. The base portion 42 engages the inner surface of the end wall of the cap. In the illustrated embodiment, a cylindrical projection 44 is formed on the inner surface of the end wall 18 of the cap for cooperating with the base portion 42 to maintain the spring member 25 centered with respect to the cap.

The base portion 42 is formed with a closure portion 40 at the inner end of the cylindrical wall of the base portion. Extending between the lower end of the base portion 42 and the inner end of the sealing wall 34 opposite flange 36 is a side wall 38. The side wall 38 is of annular cross-section, and flares outwardly in bell-shaped configuration from the periphery of the lower end of the base portion 42 to the periphery of the lower, inner end of the sealing wall 34. When the sealing member 25 is installed in the cap, it is pressed toward the end wall 18 until flange 30 snaps over the retention ribs 24 as shown in FIG. 1.

The outer surface of the mouth portion 12 of the container is formed with container locking means. The container locking means includes at least two sets of container locking elements. Each set of container locking elements includes an elongated helical guide rib 50, and a pair of spaced stop members 52 and 54 located at the leading end of the guide rib 50. The stop members 52 and 54 are located in a second helical path on the container offset from the helical path of the guide rib 50. A locking ramp 56 connects the leading end of the guide rib 50 with the stop member 52.

When the cap is placed on the container, the mouth portion 12 is received in the skirt 20 of the cap. As the cap is rotated, the locking lugs 30 each engage one of the guide ribs 50 beginning at the trailing end thereof opposite the locking ramp 56. As the cap is rotated, the guide ribs 50 cause the locking lugs 30 to pull the cap axially toward the container and simultaneously force the sealing member 25 into the mouth of the container so that the surface 35 and ribs 37 engage the mouth of the container with a tight fit. When the locking lugs 30 reaches the ramp 56, the sealing member 25 is in tight, sealing relationship with the container with the ribs 37 and the sealing wall surface 35 in tight sealing engagement with the inner surface of the container mouth. As the lugs 30 and 28 are moved passed the locking ramp 56, (the position illustrated in FIG. 6), the sealing member is flexed downwardly because of the reaction between the flange 36 and rim 14 of the container. When the locking lugs 28 and 30 reach the position illustrated in FIG. 6 such that stop member 54 is located between lugs 28 and 30, and lug 28 is located between the stop members 52 and 54, the spring portion of member 25 urges the lugs into the locked position illustrated in FIG. 3.

The engagement of the locking lugs 28 and 30 with the stop members 52 and 54 prevents rotation of the cap relative to the container. The engagement of ribs 26 with the guide ribs 50 as shown in FIG. 3 prevents axial separation of the cap from the container.

Figure 6:
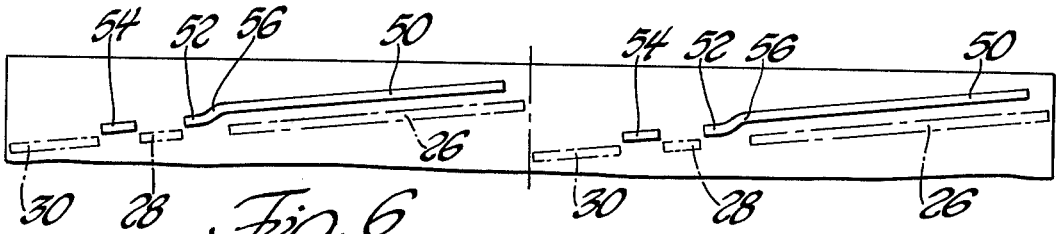
FIG. 6 is a developed view of the outer surface of the container mouth portion with the cap locking means illustrated in phantom lines.

In order to remove the cap from the container, it is necessary to press the cap toward the container against the biasing force of member 25 to disengage lugs 28 and 30 from the stop members 52 and 54 as illustrated in FIG. 6. Reverse rotation of the cap then permits the cap to be axially withdrawn from the container. The engagement of the flange 36 with the retention ribs 24 causes the spring and sealing member 25 to separate from the container with the cap.

It it is desired not to lock the cap to the container as shown in FIG. 3, rotation of the cap relative to the container can stop when the lugs 30 engage the respective locking ramps 56. In this position, the spring and sealing member 25 will be in sealing engagement with the mouth of the container, and it will not be necessary to press the cap axially toward the container before removing it.

Figure 7:
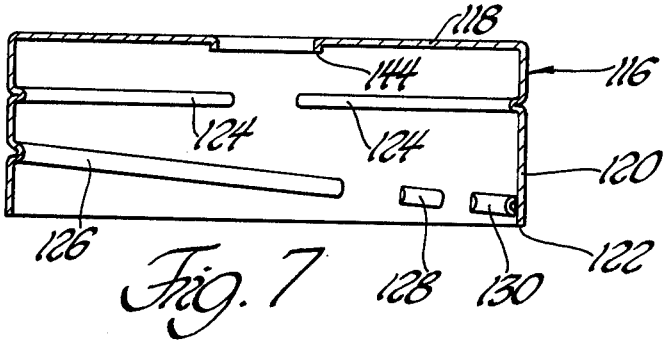
FIG. 7 is a sectional view of a modified form of the cap.

The cap 16 illustrated in FIGS. 1–5 is made of molded plastic material. FIG. 7 illustrates a modified form of the cap having the same components but made of metal. The cap 116 includes an end wall 118 with a skirt 120 projecting from the periphery thereof to an outer free end 122. The retention ribs 124 in FIG. 7, corresponding to ribs 24 of FIG. 1, are deformed out of the material of the skirt 120 by a stamping or pressure forming operation. Similarily, the ribs 126 and lugs 128 and 130, corresponding respectively to ribs 26, 28 and 30 of the previously described embodiment, are stamped or otherwise depressed out of the material of the skirt 120. A projection 144 is punched out of the end wall 118 of the metal cap 116 and surrounds an opening.

While specific forms of the invention are illustrated in the accompanying drawings and described in the foregoing specification, it should be understood that the invention is not limited to the exact construction shown. To the contrary, alterations in the construction and arrangement of parts, all falling within the scope and spirit of the invention, will be apparent to those skilled in the art.

What is claimed is:

1. A safety closure assembly comprising: a cap having an end wall with a skirt projecting axially from the periphery thereof and having a free end spaced axially from said end wall with cap locking means formed on the inner surface of the skirt adapted to be engaged with and disengaged from complementary container locking means on a container by combined axial and rotary motion of the cap relative to the container; a spring and sealing member for sealingly engaging a container to which the cap is adapted to be applied and at the same time biasing the cap locking means into locked engagement with the container locking means, said spring and sealing member including an axially extending sealing surface adapted to be received in the mouth of the container for sealing engagement with the inner surface thereof; retention means on the cap for preventing axial separation of said spring and sealing member from said cap; said cap locking means including at least two sets of cap locking elements, each set of cap locking elements being disposed in a helical path on the inner surface of said skirt and extending from a trailing end to a leading end in the direction from said end wall to the free end of said skirt, each set of cap locking elements including an elongated thread-like rib having a trailing end located at the trailing of said helical path and a leading end; said cap locking elements further including a pair of spaced locking lugs, the first of which is located at the leading end of said helical path and the second one of which is located between and spaced from said first lug and the leading end of said thread-like rib.

2. A safety closure assembly as claimed in claim 1 wherein said retention means comprises at least one retention rib projecting from the inner surface of said skirt and located between said cap locking means and the end wall of said cap, and wherein said spring and sealing member includes a radially projecting flange that engages the retention rib on the side thereof opposite the cap locking means to prevent separation of the spring and sealing member from said cap.

3. A safety closure and container assembly comprising: a container having a mouth portion with an annular rim and container locking means formed on the outer surface of said mouth portion; a cap having an end wall with a skirt projecting axially from the periphery thereof and having a free end spaced axially from said end wall with cap locking means formed on the inner surface of said skirt; said cap locking means being engageable with and disengageable from said container locking means in bayonet fashion by combined axial and rotary motion of the cap relative to the container; a combined spring and sealing member for sealingly engaging the inner surface of the container mouth and at the same time biasing the cap locking means against disengagement from the container locking means; retention means formed on said cap for preventing axial separation of said spring and sealing member from said cap when the cap is removed from the container; said container locking means including at least two set of container locking element, each set of container locking elements including an elongated guide rib located along a first helical path on the outer surface of the mouth portion of said container with a trailing end located at the traling end of said first helical path and a leading end located at the leading end of said helical path with the trailing end located axially between said leading end and the end wall of said cap; each set of container locking elements further including a pair of spaced stop members located in a second helical path on the outer surface of said mouth portion offset from said first helical path on the side of said first helical path opposite the container rim, both of said stop members being located in advance of the leading end of said guide rib and including first and second spaced stop members with the second stop member circumferentially located between the first stop member and the leading end of said guide rib, each set of container locking elements further including a locking ramp connecting said second stop member with the leading end of said guide rib; said cap locking means including at least two sets of cap locking elements, each set of cap locking elements being disposed in a helical path on the inner surface of said skirt and extending from a trailing end to a leading edge in the direction from the end wall of said cap to the free end of said skirt, each set of said cap locking elements including an elongated thread-like rib having a trailing end located at the trailing end of said last named helical path and a leading end; said cap locking elements further including a pair of spaced locking lugs, the first one of which is located at the leading end of said last named helical path and the second one of which is located between and spaced from said first lug and the leading end of said thread-like rib; each of said first locking lugs being engageable with the trailing end of one of said guide ribs as the cap is applied to the container for forcing the cap axially toward the container and the sealing member axially into the mouth of the container as the cap is rotated relative to the container until said first lugs each engage a respective one of the locking ramps, said locking ramps causing the spring and sealing member to flex as the lugs move past the locking ramp until said first stop member is located between said lugs where upon the biasing force of said spring and sealing member urges the locking lugs into locked engagement with said stop member to prevent rotation of the cap relative to the container.

* * * * *